US005924666A

United States Patent [19]

Liu

[11] Patent Number: 5,924,666

[45] Date of Patent: Jul. 20, 1999

[54] CARRIER DEVICE

[76] Inventor: Clement Liu, No. 56-3, Kan Tung Tsun, Kuei Jen Hsiang, Tainan Hsian, Taiwan

[21] Appl. No.: 09/031,449

[22] Filed: Feb. 27, 1998

[51] Int. Cl.[6] ..... E04G 3/00

[52] U.S. Cl. ..... 248/286.1; 248/278.1; 248/918

[58] Field of Search ..... 248/286.1, 279.1, 248/280.11, 284.1, 292.13, 285.1, 918; 108/140, 138

[56] References Cited

U.S. PATENT DOCUMENTS

| | | | |
|---|---|---|---|
| 4,616,798 | 10/1986 | Smeenge et al. | 248/281.1 |
| 4,706,919 | 11/1987 | Soberalski et al. | 248/281.1 |
| 5,037,054 | 8/1991 | McConnell | 248/284 |
| 5,145,136 | 9/1992 | McConnell | 248/284 |
| 5,257,767 | 11/1993 | McConnell | 248/284 |
| 5,791,263 | 8/1998 | Watt et al. | 108/138 |

*Primary Examiner*—Ramon O. Ramirez
*Assistant Examiner*—Gwendolyn Baxter
*Attorney, Agent, or Firm*—Rosenberg, Klein & Bilker

[57] ABSTRACT

A carrier device includes a mounting seat securely attached to an object and a connecting seat attached to and movable relative to the mounting seat, the connecting seat including a first transverse pin mounted to a first end thereof and a second transverse pin mounted to a second end thereof. A stop plate is pivotally mounted to the connecting seat and includes a retaining section. A movable seat includes a first end pivotally connected to the connecting seat and a second end. The first end of the movable seat includes two aligned arcuate slots through which the second pin extends. An engaging plate includes a first end having aligned slots through which the second pin extends and a second end having a third pin mounted thereto. The engaging plate further including an engaging section for releasably engaging with the retaining section of the stop plate. A spring includes a first end securely attached to the first transverse pin and a second end securely attached the third pin mounted to the engaging plate. A carrier plate includes an end pivotally connected to the second end of the engaging plate and the second end of the movable seat.

2 Claims, 5 Drawing Sheets

CARRIER DEVICE

BACKGROUND OF THE INVENTION

1. Field of the Invention

The present invention relates to a carrier device which may be used to support a keyboard, typewriter, books, etc.

2. Description of the Related Art

Computers, typewriters, etc. are popular business machines, yet the desks generally have limited upper side area such that a relatively small space is left after placing a computer and/or a typewriter on it. A carrier device with a fixed height has been proposed for the user to put a keyboard, typewriter, books, or other articles thereon. Nevertheless, the user may feel uncomfortable due to staying in an incorrect gesture since the height of the carrier device is fixed.

Therefore, there has been a long and unfulfilled need for an improved carrier device which mitigates and/or obviates the above problems.

SUMMARY OF THE INVENTION

A carrier device in accordance with the present invention comprises:

- a mounting seat adapted to be securely attached to an object,
- a connecting seat attached to and movable relative to the mounting seat, the connecting seat including a first transverse pin mounted to a first end thereof and a second transverse pin mounted to a second end thereof,
- a stop plate pivotally mounted to the connecting seat by the first transverse pin and the second transverse pin, said stop plate further including a retaining section,
- a movable seat including a first end pivotally connected to the connecting seat by the first transverse pin and the second transverse pin and a second end, the first end of the movable seat including two aligned arcuate slots through which the second pin extends,
- an engaging plate including a first end having aligned slots through which the second pin extends and a second end having a third pin mounted thereto, said engaging plate further including an engaging section for releasably engaging with the retaining section of the stop plate,
- a spring including a first end securely attached to the first transverse pin and a second end securely attached the third pin mounted to the engaging plate, and
- a carrier plate including an end pivotally connected to the second end of the engaging plate by the third pin and pivotally connected to the second end of the movable seat.

When the carrier plate is moved toward the connecting seat, the engaging section of the engaging plate disengages from the stop plate to allow adjustment of height of the carrier plate. When the carrier plate is loaded, the carrier plate is moved away from the connecting seat which causes the engaging section to engage with the retaining plate to retain the carrier plate in a horizontal position.

The second pin further comprises a positioning knob mounted to an end thereof to adjust frictional force for retaining the connecting seat, the movable seat, and the engaging seat in position.

Other objects, advantages, and novel features of the invention will become more apparent from the following detailed description when taken in conjunction with the accompanying drawings.

DESCRIPTION OF THE PREFERRED EMBODIMENT

Figure 1:
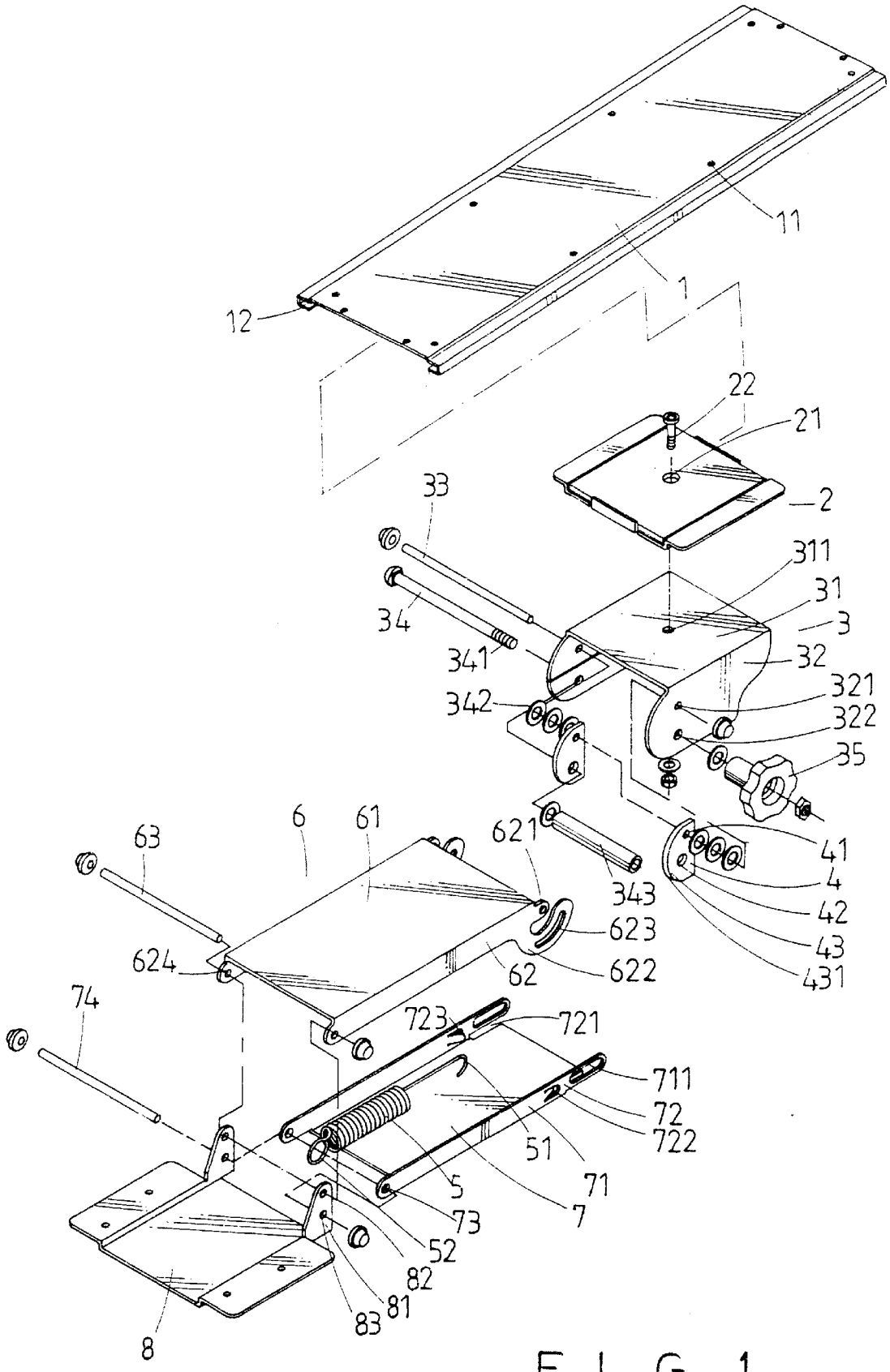
FIG. 1 is an exploded perspective view of a carrier device in accordance with the present invention.
Figure 2:
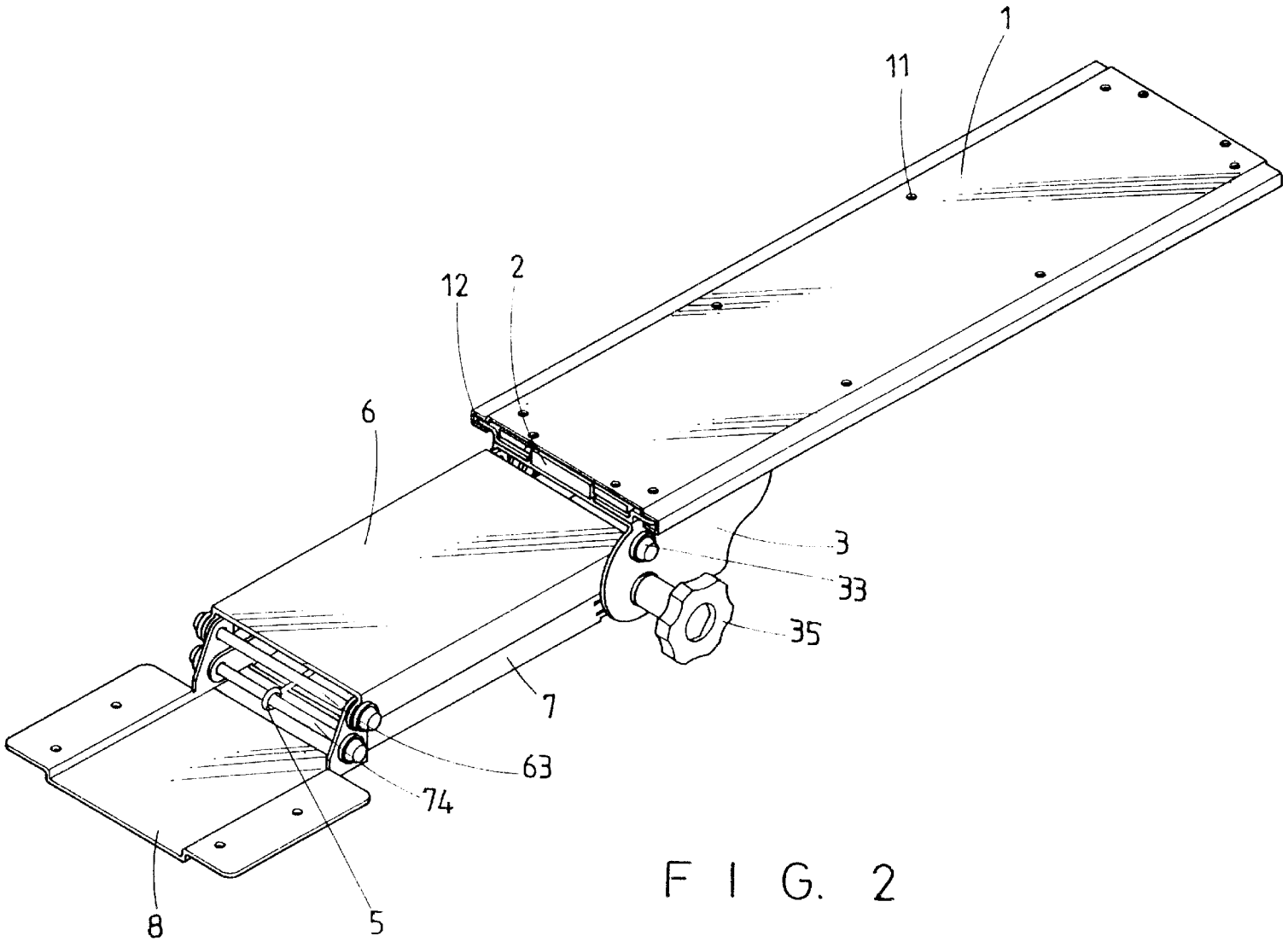
FIG. 2 is a perspective view of the carrier device in accordance with the present invention.

Referring to the drawings and initially to FIGS. 1 and 2, a carrier device in accordance with the present invention generally includes a mounting seat 1, a sliding plate 2, a connecting seat 3, at least one stop plate 4 (there are two stop plates 4 in this embodiment), a spring 5, a movable seat 6, an engaging plate 7, and a carrier plate 8.

The mounting seat 1 is securely attached to an object, e.g., an underside of a desk (not shown) by screws (not shown) extending through holes 11 defined therein. The mounting seat 1 further includes a groove track 12 for slidably receiving the sliding plate 2 which, in turn, is securely attached to the connecting seat 3 by a screw 22 extending through a screw hole 21 defined in the sliding plate 2 and a screw hole 311 defined in the connecting seat 3. In this embodiment, the connecting seat 3 may be adjusted to a desired angular position relative to the sliding plate 2.

The connecting seat 3 includes two downwardly extending lateral plates 32 having aligned holes 321 and 322 for respectively receiving pins 33 and 34, wherein the pin 33 further extends through holes 621 defined in the movable seat 6 and holes 41 defined in the stop plates 4, and wherein the pin 34 further extends through arcuate slots 623 defined in the movable seat 6, washers 342, slots 711 defined in the engaging plate 7, and holes 42 defined in the stop plates 4. A tube 343 is mounted around the pin 34 and between the stop plates 4. Further, the pin 34 includes a threaded end 341 for threadedly engaging with a positioning knob 35 to control the frictional force between the connecting seat 3, the stop plates 4, the movable seat 6, and the engaging plate 7.

The stop plates 4 are respectively mounted to the lateral plates 32 and each further includes a retaining section 43 with a retaining edge 431 for releasably engaging with an engaging section 72 of the engaging plate 7.

Figure 3:
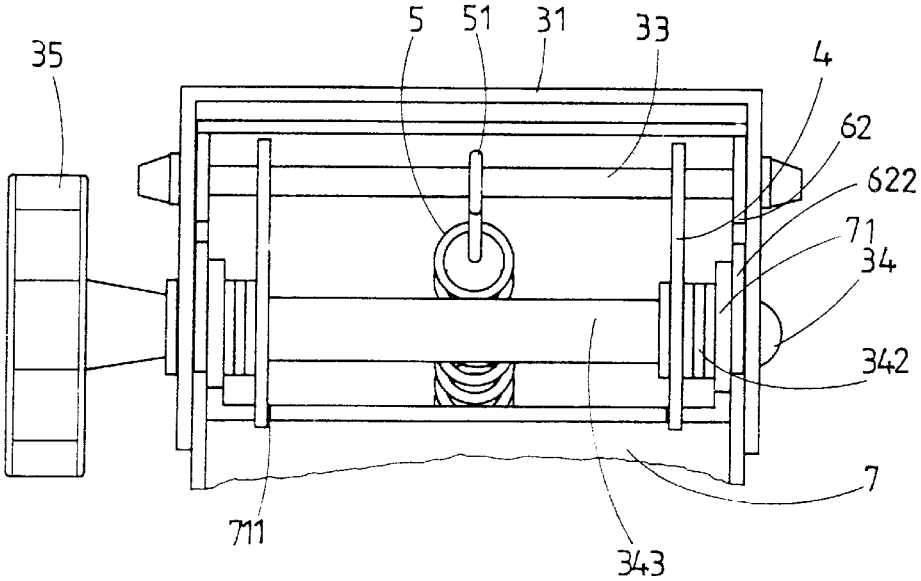
FIG. 3 is a partial bottom view of a portion of the carrier device.

The spring 5 includes a first end 51 securely attached to the pin 33 (FIG. 3) and a second end 52 securely attached to a pin 74 mounted to the engaging plate 7.

The movable seat 6 includes a top plate 61 and two side plate 62. The side plates 62 includes the holes 621 defined in first ends thereof, the holes 621 being aligned with the holes 321 and extended by the pin 33. Each side plate 62 further includes an engaging section 622 having the arcuate slot 623 defined therein through which the pin 34 extends. The first end of the movable seat 6 is thus pivotally connected to the connecting seat 3. Further, the movable seat 6 further includes aligned holes 624 defined in a second end thereof through which a pin 63 is extended.

The engaging plate 7 is mounted between the side plates 62 of the movable seat 6 and includes two side plates 71 having aligned slots 711 defined in first ends thereof through which the pin 34 is extended. Further, each side plate 71 further includes an engaging section 72 having an engaging slot 723 defined between an engaging protrusion 722 (projecting from the engaging section 72) and the side plate 71. The engaging slot 723 may releasably engage with the engaging edge 431 of the associated stop plate 4. The side plates 71 further includes aligned holes 73 defined in second ends thereof through which the pin 74 extends.

The carrier plate 8 includes an engaging section, e.g., in the form of a pair of wings 81 formed on an end thereof. The wings 81 have aligned holes 82 which are aligned with the holes 624 of the movable plate 6 and through which the pin 63 extends. The wings 81 further have aligned holes 83 which are aligned with holes 73 of the engaging plate 7 and through which the pin 74 extends.

Figure 4:
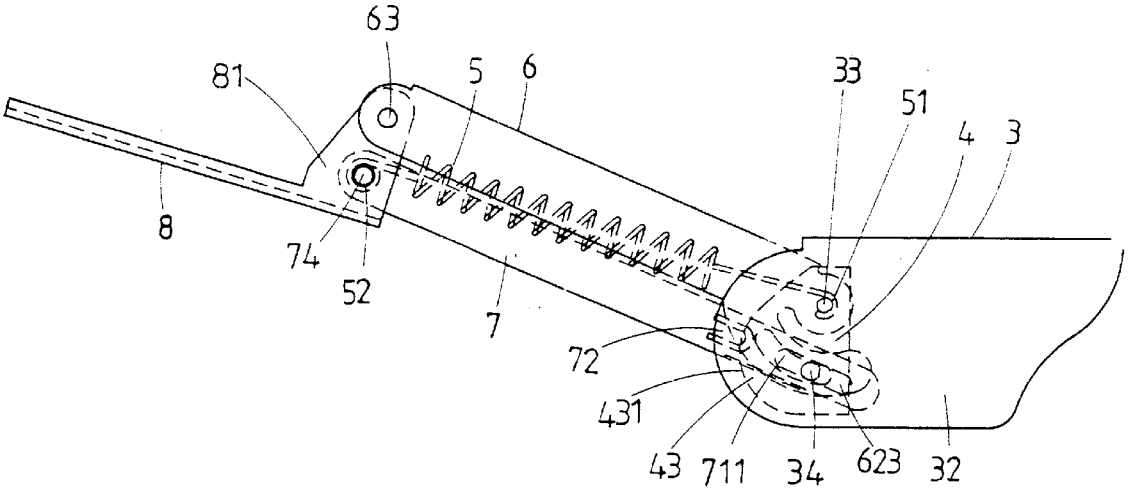
FIG. 4 is a side view illustrating height adjustment of the carrier device.

When not loaded, the carrier plate 8 is in an upwardly extending position shown in FIG. 4 under the action of the spring 5. When adjusting the height of the carrier plate 8, the wings 81 are moved toward the connecting seat 3 which also causes the connecting plate 7 to move toward the connecting seat 3 such that the engaging sections 72 have a distance from the stop plates 4. As a result, the carrier plate 8, the movable seat 6, and the engaging plate 7 may be adjusted in their heights simultaneously, while the displacements of the movable seat 6 and the engaging plate 7 are restrained by the slots 623 and the slots 711. The carrier plate 8 is then moved downwardly and thus pulls the spring 5.

Figure 5:
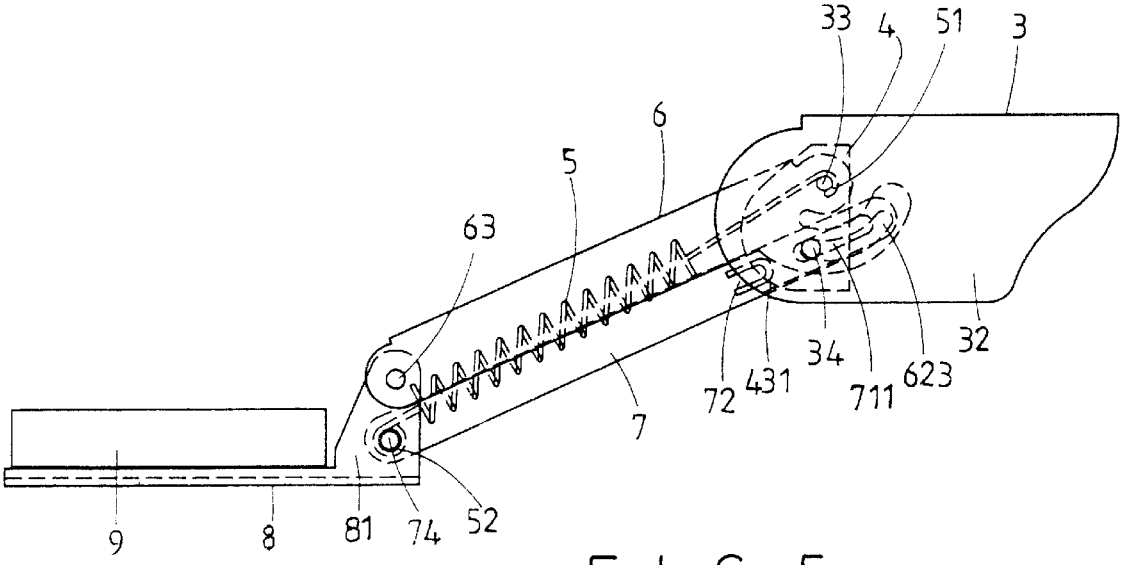
FIG. 5 is a side view similar to FIG. 4, wherein an article is placed on the carrier device.

Referring to FIG. 5, after adjustment of the height of the carrier plate 8, and if an article, e.g., a keyboard 9 is placed on the carrier plate 8, the wings 81 are moved away from the connecting seat 3 which also causes the engaging plate 7 to move away from the connecting seat 3. As a result, the engaging sections 72 engage with the retaining sections 43 of the stop plates 4, respectively, while the engaging slots 723 engage with the retaining edges 431 of the stop plates 4, respectively. Accordingly, the movable seat 6, the engaging plate 7 and the connecting seat 3 have fixed angular engaging relationships therebetween while the height of the carrier plate 8 is retained. Due to provision of, the retaining sections 431 and the engaging sections 72 of the engaging plate 7, the carrier plate 8, regardless of the height thereof, is retained in a horizontal position when loaded.

Figure 6:
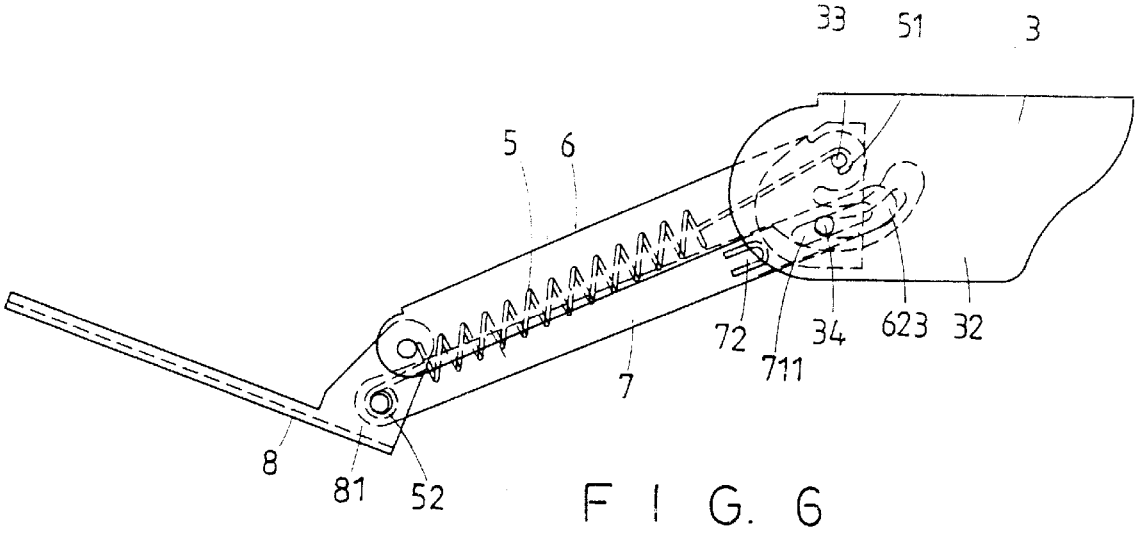
FIG. 6 is a side view similar to FIG. 4, wherein a carrier plate of the carrier device is retained in position.

Referring to FIG. 6, when the height of the carrier plate 8 has been adjusted, the positioning knob 35 is tightened such that the connecting seat 3, the stop plates 4, the movable seat 6, the washers 342, the engaging plate 7, the stop plates 4, and the sleeve 343 have fixed relative positional relationships therebetween to thereby fix the height of the carrier plate 8.

When re-adjustment of the height of the carrier plate 8 is required, the positioning knob 35 is firstly loosened, and the article 9 on the carrier plate 8 is then removed. As a result, the carrier plate 8, the engaging plate 7, and the movable seat 6 slowly move upwardly to allow easy height adjustment in a manner described above.

Figure 7:
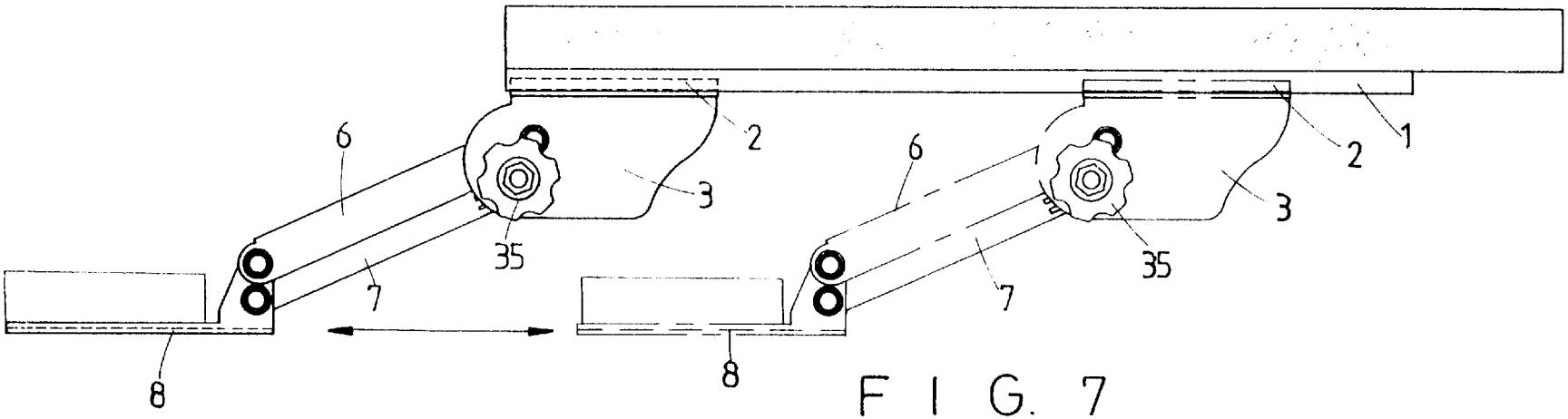
FIG. 7 is a schematic side view illustrating sliding movement of the carrier device.
Figure 8:
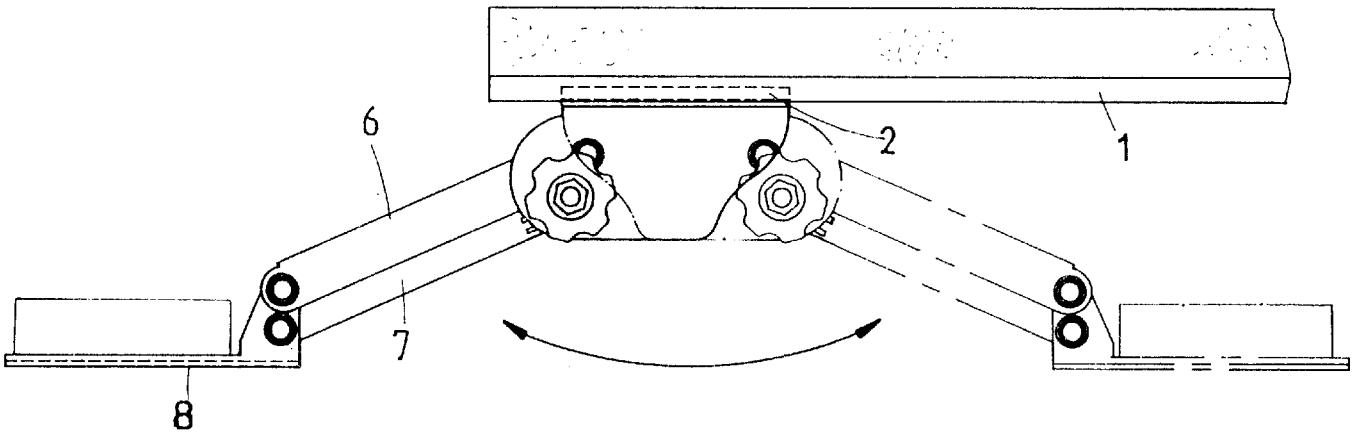
FIG. 8 is a schematic side view illustrating pivotal movement of the carrier device.

Referring to FIG. 7, when not in use, the carrier plate 8 may be shifted to a stored position (the right one) by means of simply sliding the sliding seat 2. Alternately, the angular relationship between the connecting seat 3 and the sliding plate 2 can be changed to put the carrier plate 8 to the stored position, as shown in FIG. 8.

Although the invention has been explained in relation to its preferred embodiment, it is to be understood that many other possible modifications and variations can be made without departing from the spirit and scope of the invention as hereinafter claimed.

What is claimed is:

1. A carrier device, comprising:

a mounting seat adapted to be securely attached to an object, a connecting seat attached to and movable relative to the mounting seat, the connecting seat including a first transverse pin mounted to a first end thereof and a second transverse pin mounted to a second end thereof, a stop plate pivotally mounted to the connecting seat by the first transverse pin and the second transverse pin, said stop plate further including a retaining section, a movable seat including a first end pivotally connected to the connecting seat by the first transverse pin and the second transverse pin and a second end, the first end of the movable seat including two aligned arcuate slots through which the second pin extends, an engaging plate including a first end having aligned slots through which the second pin extends and a second end having a third pin mounted thereto, said engaging plate further including an engaging section for releasably engaging with the retaining section of the stop plate, a spring including a first end securely attached to the first transverse pin and a second end securely attached the third pin mounted to the engaging plate, and a carrier plate including an end pivotally connected to the second end of the engaging plate by the third pin and pivotally connected to the second end of the movable seat, whereby when the carrier plate is moved toward the connecting seat, the engaging section of the engaging plate disengages from the stop plate to allow adjustment of height of the carrier plate, and when the carrier plate is loaded, the carrier plate is moved away from the connecting seat which causes the engaging section to engage with the retaining plate to retain the carrier plate in a horizontal position.

2. The carrier device according to claim 1, wherein the second pin further comprises a positioning knob mounted to an end thereof to adjust frictional force for retaining the connecting seat, the movable seat, and the engaging seat in position.

* * * * *